US009919769B2

(12) United States Patent
Day et al.

(10) Patent No.: US 9,919,769 B2
(45) Date of Patent: Mar. 20, 2018

(54) DEVICE FOR INTERCONNECTING A FIRST TETHER AND A SECOND TETHER

(71) Applicant: Anchor Bridle Pty Ltd, Castle Hill, New South Wales (AU)

(72) Inventors: James Day, Castle Hill (AU); Andrew Hughes, Baulkham Hills (AU)

(73) Assignee: Anchor Bridle Pty Ltd, Castle Hill (AU)

( * ) Notice: Subject to any disclaimer, the term of this patent is extended or adjusted under 35 U.S.C. 154(b) by 0 days.

(21) Appl. No.: 14/792,662

(22) Filed: Jul. 7, 2015

(65) Prior Publication Data

US 2016/0001852 A1 Jan. 7, 2016

(30) Foreign Application Priority Data

Jul. 7, 2014 (AU) ..... 2014902613

(51) Int. Cl.

| | |
|---|---|
| ***B63B 21/04*** | (2006.01) |
| ***F16G 11/00*** | (2006.01) |
| ***F16G 11/14*** | (2006.01) |
| ***B63B 21/20*** | (2006.01) |

(52) U.S. Cl.

CPC ..... *B63B 21/20* (2013.01); *B63B 2021/203* (2013.01)

(58) Field of Classification Search

CPC ... B63B 21/20; B63B 2021/203; F16G 11/04; F16G 11/14

USPC ..... 114/213, 216, 230.25, 230.26

See application file for complete search history.

(56) References Cited

U.S. PATENT DOCUMENTS

| | | | | |
|---|---|---|---|---|
| 2,048,300 A * | 7/1936 | Showers | D06F 53/00 | 24/130 |
| 5,423,693 A * | 6/1995 | Light | H01R 13/6392 | 439/369 |
| 8,650,725 B1 * | 2/2014 | Cooper | E04H 15/64 | 135/119 |
| 8,661,624 B1 * | 3/2014 | Bracewell | B63B 21/08 | 24/129 B |
| 2005/0061905 A1 * | 3/2005 | Sherman | F16G 11/14 | 242/388.2 |

FOREIGN PATENT DOCUMENTS

WO WO 03033340 A1 * 4/2003 ..... B63B 21/04

* cited by examiner

*Primary Examiner* — Anthony D Wiest

(74) *Attorney, Agent, or Firm* — Galgano IP Law PLLC; Thomas M. Galgano; Jessica G. McDonald

(57) ABSTRACT

A device for interconnecting two tethers. The device comprises a body arranged to secure a first tether thereto and has an aperture therein for receiving a second tether. An arm extends from the body and away from the aperture. In use, the second tether is arranged to form a loop, passed through the aperture and around the arm, thereby allowing the device to interconnect the first and second tethers.

8 Claims, 4 Drawing Sheets

DEVICE FOR INTERCONNECTING A FIRST TETHER AND A SECOND TETHER

TECHNICAL FIELD

The present invention relates generally to a device for interconnecting two tethers, and particularly relates to a device for interconnecting tethers secured to a boat floating on a body of water.

BACKGROUND TO THE INVENTION

When a boat is temporarily secured in a stationary position whilst on a body of water, for example, when a user is fishing in a preferred location at sea, it is commonplace to use an anchor to secure the boat to a bed of the body of water, to prevent the boat from moving away from the preferred location. The anchor is usually attached to an anchor line, being a rope or chain, and the line is connected to a bow of the boat and lowered to ground level to anchor the boat in position. In this scenario, the anchored boat is inevitably reorientated by a prevalent current or wind such that the boat becomes positioned downstream of the anchor, having its bow, facing the anchor.

In some instances, a user will need to reorientate or move the anchored boat relative to the anchor in order to access an alternative location. For example, when a user is fishing at sea, a user may need to adjust the position of a boat to improve access to a particular location where fish have collected. When using a single anchor arrangement as described above, this can be difficult to maintain as this requires the user to operate the boat's motor. When the motor ceases to operate, the boat will return to its original position downstream of and facing the anchor.

To overcome this issue, it is known for boat user to use two anchors and respective anchor lines to anchor the vessel in position. In this arrangement, each anchor line is secured at an angle from the boat which allows the boat to be repositioned relative to the anchors by extending or retracting the anchor lines, pulling the boat in the direction of one or other of the anchors and reorientating the boat with respect to a particular location of interest.

Whilst the dual anchor arrangement can function satisfactorily there are a number of drawbacks with this approach. To install both anchors can take considerable time and effort, unnecessarily consuming engine fuel whilst adjusting the boats position to set both anchors. Furthermore, once set up, it is awkward to reposition the boat as the anchor lines must be adjusted in length simultaneously, which can prove very difficult for a single operator. Furthermore, the dual anchor lines can occupy a significant area around the boat, increasing the chance of fouling other passing boats. It is also a costly solution, requiring the purchase of an additional anchor and line.

Accordingly, it would be useful to provide a device that allows an anchored boat having a single anchor to be repositioned and/or reorientated relative to the anchor. Furthermore, it would be useful if such a device could be installed and operated by a single user quickly and with minimal effort. In general, it would be useful to provide a solution that avoids or ameliorates any of the disadvantages present in the prior art or which provides another alternative to the prior art approaches.

SUMMARY OF THE INVENTION

According to one aspect of the invention there is provided a device for interconnecting a first tether and a second tether having a body arranged to secure the first tether thereto and an aperture therein for receiving the second tether, and an arm extending away from the aperture, wherein, in use, the second tether is arranged to form a loop which passes through the aperture and around the arm, thereby interconnecting the first and second tethers.

Other aspects are disclosed.

BRIEF DESCRIPTION OF THE DRAWINGS

Preferred embodiments of the invention will now be described, by way of example only, with reference to the accompanying drawings in which.

DETAILED DESCRIPTION OF PREFERRED EMBODIMENTS

Figure 1:
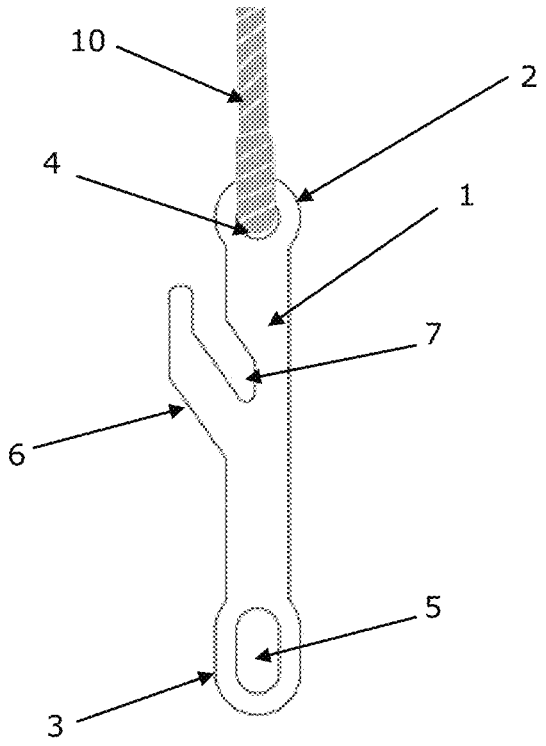
FIGS. 1 to 3 are front views of the device, connected to one or two tethers.

The present disclosure relates generally to a device for interconnecting a first tether to a second tether, to allow a boat floating on a body of water to be reorientated relative to a fixed position.

In particular, the disclosure relates to a device for interconnecting a first tether and a second tether having a body arranged to secure the first tether thereto and an aperture therein for receiving the second tether, and an arm extending away from the aperture, wherein, in use, the second tether is arranged to form a loop which passes through the aperture and around the arm, thereby interconnecting the first and second tethers.

The disclosure further relates to a method of adjusting an orientation of a boat floating on a body of water by using the device, the method comprising the steps of: connecting a first tether between a first position on the boat and the device; connecting a second tether between a second position on the boat a fixed position; arranging the second tether to form a loop; passing the loop through the aperture in the device and over the arm, thereby securing the second tether to the device; and adjusting a length of at least one of the first and second tethers, thereby reorientating the boat relative to the fixed position.

Typically, the first tether is a fixed length of auxiliary line and the second tether is an anchor line, connected between the boat and an anchor, and the device is used to cleat the auxiliary line thereby temporarily fixing the auxiliary line to the anchor line. When utilised in this way, the auxiliary line is typically tensioned, due to a prevalent current or wind, allowing the portion of anchor line between the device and the boat to be adjusted in length, thereby reorientating the boat relative to the anchor position, being where the anchor engages a bed of the body of water.

When the device is installed to the anchor line and auxiliary line and both the anchor line and the auxiliary line are connected proximal a bow of the boat, shortening either line moves the boat substantially linearly towards and away from the anchor point, allowing a user to access different locations in the water adjacent the boat. Alternatively, where the lines are connected proximal to opposite ends of the boat, for example, the auxiliary line proximal to the bow and the anchor line proximal to a stern, shortening the anchor line rotates the boat relative to the anchor point, similarly allowing a user to access alternative locations adjacent to the boat.

In general, connecting the device to two tethers connected to the boat will allow the boat to be manoeuvred with respect to a fixed position by adjusting the length of one or both tethers. This offers the advantage of a single user being able to reorientate and easily manoeuvre the boat. Furthermore, if experiencing inclement weather, this can be performed from the safety of a cabin of the boat. This better facilitates certain maritime activities, such as fishing at sea. Furthermore, the device removes the need to set two anchors, reducing costs of equipment required and fuel consumption during installation of the anchors.

The device is particularly directed towards allowing a user having little knowledge of ropes and knots to rapidly and firmly interconnect one tether with another. The device includes at least one aperture through one or both tethers are passed and a locking arm extending away therefrom, which is configured to allow a loop of at least one tether to be passed thereover and secured. This arrangement ensures the looped tether is passed back on itself, locking the rope to the device and providing a firm connection.

Figure 2:
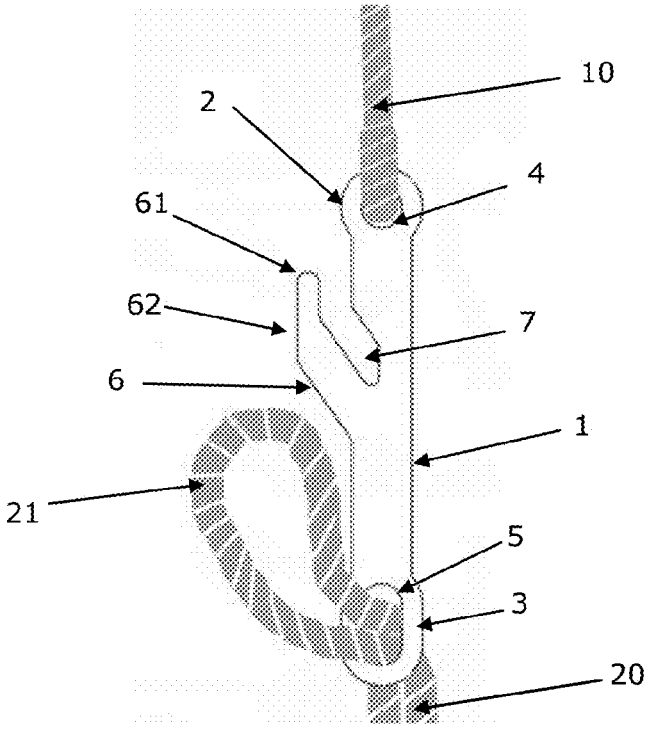
Figure 3:
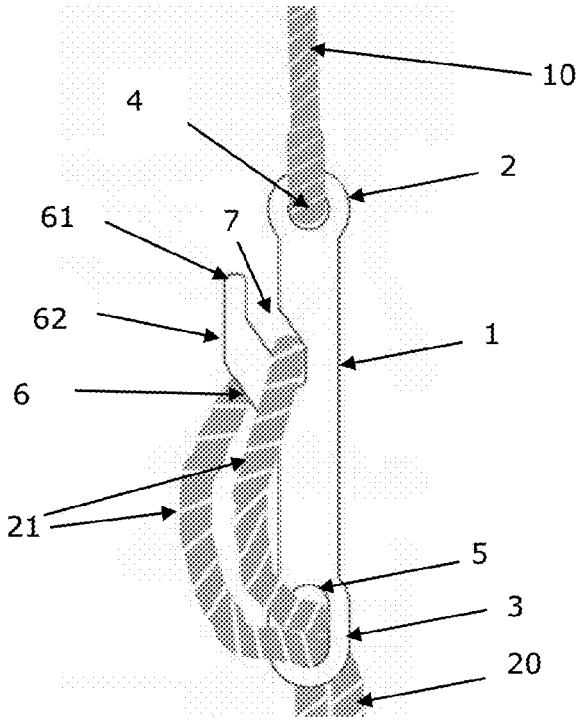

In FIGS. 1 to 3, the device 1 is shown interconnecting a first tether 10, being an auxiliary line, and a second tether 20, being an anchor line. The device 1 has an elongate body having a first end 2 and a second end 3 and a longitudinal axis (not shown) extending therebetween. A first aperture 4 is arranged proximal the first end 2 and extending through the body, through which the first tether 10 is passed and secured. Proximal to the second end 3 of the body is a second aperture 5 dimensioned to receive at least two sections of tether. An arm 6 extends from the body and away from the second aperture 5, forming a free end 61. The arm 6 has an angled portion 62 extending further towards the first end 2. At a junction of the arm 6 and the body is a recess 7 dimensioned to at least partly receive the second tether 20.

In use, the first tether 10 is secured to the body, either directly, such as by passing through the first aperture 4 and being secured to itself or the boat, or indirectly, such as with a releasable connector, such as a carabiner. The second tether 20 is arranged to form a loop 21, and the loop 21 is passed through the second aperture 5 and over the arm 6. When the second tether 20 is tensioned, such as by a current or wind moving the boat on the body of water, the arrangement of the arm 6 ensures the loop 21 is urged towards the junction of the arm 6 and the body, and into the recess 7, thereby firmly engaging the device 1. The relationship of the arm 6 extending at an angle away from the elongate body and the second aperture 5, the angled portion 62, and the recess 7 decreases the likelihood of the second tether 20 disengaging the device 1, for example, when tension in the second tether is reduced. Preferably, the recess 7 extends at least up to the longitudinal axis to assist with preventing non-intentional disengagement of the second tether 20 from the device 1.

In an alternative embodiment (not shown), the device 1 further comprises a second arm extending away from the first aperture 4, and the first tether 10 is secured to the device 1 by arranging the first tether 10 to form a loop, and passing the loop through the first aperture 4 and over the second arm, similar to the engagement of the second tether 20 with the arm 6.

In a further alternative embodiment (not shown), the device comprises a body forming a ring having an aperture therethrough and an arm extending substantially radially to the aperture and having a free end distal to the aperture. In this embodiment, the first tether 10 is secured to a portion of the ring opposite to the arm and the second tether 20 is secured as described above, by arranging the second tether 20 to form a loop and passing the loop through the aperture and over the arm, thereby interconnecting the first and second tethers 10, 20. To assist preventing the second tether 20 disengaging the device, the arm may have at least two retaining arms extending from the free end, thereby forming at least two respective hooks.

Figure 4:
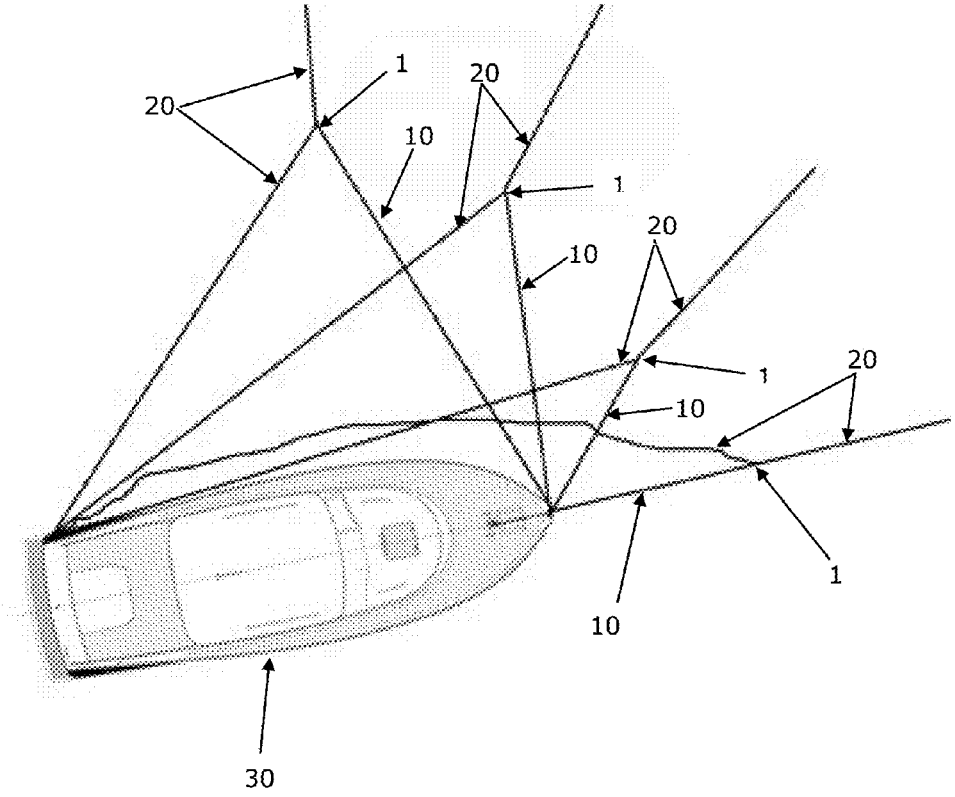
FIG. 4 is a top view of the device in use, illustrating three usage scenarios.
Figure 4:
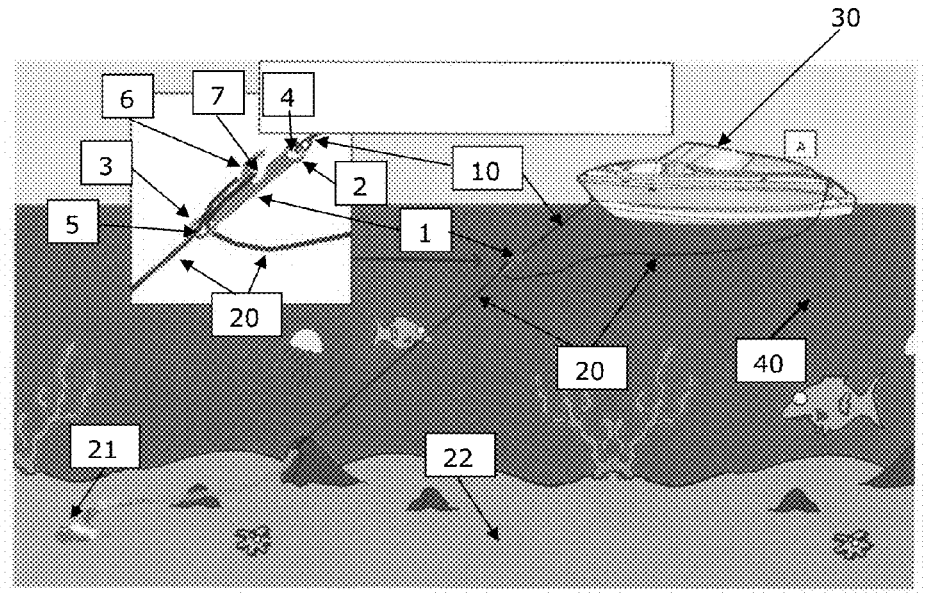

In FIG. 4, the device 1 is shown secured to the first tether 1, being an auxiliary line 10 connected to the bow of the boat 30, and engaged with the second tether 20, being an anchor line connected between an anchor 21 and the stern of the boat 30. Due to the prevalent current in the body of water 40, the boat 30 is moved towards the right-hand side of FIG. 4, tensioning the first tether 10 and the lower portion of the second tether 20 connected between the anchor 21 and the device 1. This has resulted in the upper portion of the second tether 20 going slack.

To set up the arrangement shown in FIG. 4, the user anchors the boat 30, typically by lowering the anchor from the boat to the bed, allowing the anchor to engage with the bed, and then reversing the boat to increase tension in the anchor line 20. The device 1 is secured to a fixed length of auxiliary line 10 which is connected to a position on the boat 30. A section of anchor line 20 is gripped by the user and arranged in a loop, and the loop passed through the second aperture 5 and over the locking arm 6 such that the loop is retained between the locking arm 6 and the body. The anchor line 20 is released by the user, and, due to the prevalent current acting on the boat 30, is dragged into the water until the auxiliary line 10 is fully extended. This causes the lower portion of anchor line 20 to be tensioned, exerting a force on the second end 3 of the device 1, and the auxiliary line 10 is tensioned, exerting an equal and opposite force on the first end 2 of the device 1.

When installed in this way, the boat 30 remains anchored in a stationary position with the connection location of the auxiliary line 10 being the foremost position and the remainder of the boat urged downstream. The upper portion of the anchor line 20 may be allowed to go slack by allowing more line 20 to be released from the boat 30, or retracted when the user wishes to adjust the orientation and/or position of the boat 30 relative to the position of the anchor. For example, as the anchor line 20 is connected towards the stern of the boat 30, if the user decreases the length of the line 20, the stern of the boat 30 will rotate towards the anchor. Alternatively, should both lines 10, 20 be connected to the boat 30 near the bow, when the anchor line 20 is retracted, the boat 30 would move linearly, towards the anchor.

It will be appreciated that the arrangement shown in FIG. 4 is merely one example of how the device 1 can be used to interconnect two tethers 10, 20 and reorientate the boat 30, and that a number of factors may be varied to provide alternative results. For example, the connection locations of the tethers 10, 20 may be reversed, such that the anchor line 20 is connected proximal to the bow. The auxiliary line 10 may also be adjustable in length, allowing the boat 30 to be rotated in the opposite direction.

The arrangement shown in FIG. 4 shows the device 1 connected to the first and second tethers 10, 20 in three different scenarios of adjusting the length of one or both tethers 10, 20 in order to reorientate the boat 30 relative to the anchor (not illustrated). It will be appreciated that whilst the device 1 has been described as being useful to reorientate the boat 30 relative to the anchor, the device 1 may be used to reorientate the boat 30 relative to any fixed position the second tether 20 is connected to.

Although the invention is described above with reference to specific embodiments, it will be appreciated that it is not limited to those embodiments and may be embodied in other forms.

The invention claimed is:

1. A device for interconnecting a first tether and a second tether, the device comprising:

an elongate body having a longitudinal axis and having opposed first and second ends, the elongate body further comprising a first aperture on the first end and a second aperture at the second end, the first aperture being configured to secure the first tether thereto, and the second aperture being configured to receive a looped intermediate portion of the second tether; and an arm extending outwardly from an edge of the elongate body, from an intermediate portion thereof, at an angle from the longitudinal axis and away from the second aperture to a distal region to provide a locking recess for the second tether, the arm comprising a hooked portion extending parallel to the longitudinal axis from the distal region, such that at least a portion of the locking recess is outside the elongate body and between the arm and an edge of the elongate body; and wherein the elongate body includes a main web portion disposed substantially along the longitudinal axis between the first and second ends, such that the first and second apertures are aligned on the longitudinal axis, and connected by the web portion to facilitate axial transfer of forces between the first and second ends.

2. The device according to claim 1, wherein the arm has a free end, thereby allowing the looped portion of the second tether to pass thereover and engage the arm.

3. The device according to claim 1, wherein the body is buoyant.

4. The device according to claim 1, wherein the second aperture is an elongate slot having a longitudinal axis extending along the elongate body.

5. A method of adjusting an orientation of a boat floating on a body of water, the method comprising the steps of:

providing a device for interconnecting a first tether and a second tether, the device comprising an elongate body having a longitudinal axis and having opposed first and second ends, the elongate body further comprising a first aperture on the first end and a second aperture at the second end, the first aperture being configured to secure the first tether thereto, and the second aperture being configured to receive a looped intermediate portion of the second tether; and an arm extending outwardly from an edge of the elongate body, from an intermediate portion thereof, at an angle from the longitudinal axis and away from the second aperture to a distal region to provide a locking recess for the second tether, the arm comprising a hooked portion extending parallel to the longitudinal axis from the distal region, such that at least a portion of the locking recess is outside the elongate body and between the arm and an edge of the elongate body; and wherein, the elongate body includes a main web portion disposed substantially along the longitudinal axis between the first and second ends, such that the first and second apertures are aligned on the longitudinal axis, and connected by the web portion to facilitate axial transfer of forces between the first and second ends;

connecting a first tether between a first position on the boat and said device;

connecting a second tether to a second fixed position spaced from the first position on the boat;

arranging the second tether to form a loop at an intermediate position;

passing the loop through the second aperture in the device and over the arm of the device, thereby securing the second tether to the device within the locking recess; and adjusting a length of at least one of the first and second tethers, thereby reorientating the boat relative to the fixed position.

6. The method according to claim 5, wherein the second tether is an anchor line connected to an anchor and the fixed position is a point of engagement between the anchor and a bed of the body of water, and wherein the step of adjusting the length of at least one of the first and second tethers further comprises adjusting the length of the second tether.

7. The method according to claim 5, wherein the first location is arranged proximal to a bow of the boat, and wherein the step of adjusting the length of at least one of the first and second tethers further comprises adjusting the length of the first tether, thereby adjusting the position of the bow relative to the fixed position.

8. The method according to claim 7, wherein the second location is arranged proximal to a stern of the boat, and wherein the step of adjusting the length of at least one of the first and second tethers further comprises adjusting the length of the second tether, thereby adjusting the position of the stern relative to the fixed position.

* * * * *